US009340058B2

(12) United States Patent
Yoo et al.

(10) Patent No.: US 9,340,058 B2
(45) Date of Patent: May 17, 2016

(54) BLANKET FOR OFFSET PRINTING AND MANUFACTURING METHOD THEREFOR

(75) Inventors: Houng-Sik Yoo, Seoul (KR); Beom-Mo Koo, Daejeon (KR); Soon-Yeol Lee, Daejeon (KR); Seung-Heon Lee, Daejeon (KR); Jin-Young Park, Daejeon (KR)

(73) Assignee: LG CHEM, LTD., Seoul (KR)

( * ) Notice: Subject to any disclaimer, the term of this patent is extended or adjusted under 35 U.S.C. 154(b) by 98 days.

(21) Appl. No.: 13/635,859

(22) PCT Filed: Mar. 18, 2011

(86) PCT No.: PCT/KR2011/001891

§ 371 (c)(1),
(2), (4) Date: Sep. 18, 2012

(87) PCT Pub. No.: WO2011/115452

PCT Pub. Date: Sep. 22, 2011

(65) Prior Publication Data

US 2013/0008330 A1 Jan. 10, 2013

(30) Foreign Application Priority Data

Mar. 19, 2010 (KR) ..... 10-2010-0024859

(51) Int. Cl.
*B41C 3/08* (2006.01)
*B41N 10/04* (2006.01)

(52) U.S. Cl.
CPC ..... *B41N 10/04* (2013.01); *B41N 2207/02* (2013.01); *B41N 2207/14* (2013.01); *B41N 2210/02* (2013.01); *B41N 2210/04* (2013.01); *B41N 2210/14* (2013.01)

(58) Field of Classification Search
CPC ..... B41N 10/00; B41N 10/02; B41N 10/04; B41N 10/06; B41N 2210/00; B41N 2210/02; B41N 2210/04; B41N 2210/06; B41N 1/16; B41N 1/22; B41F 27/12
USPC ..... 101/401.1, 401, 379, 375, 376, 368; 430/124.33, 124.35, 272.1
See application file for complete search history.

(56) References Cited

U.S. PATENT DOCUMENTS 6,562,180 B1 * 5/2003 Bohin ..... C08L 83/04 156/306.3
7,754,298 B2 * 7/2010 Soria et al. ..... 428/32.51
2008/0156212 A1 * 7/2008 Yamada et al. ..... 101/375

FOREIGN PATENT DOCUMENTS

EP 0 360 614 A3 3/1990
EP 0360614 A3 3/1990

(Continued)

OTHER PUBLICATIONS

Shin-Etsu Silicone Performance Test Result (first published 2004).*

(Continued)

*Primary Examiner* — Daniel J Colilla
*Assistant Examiner* — Quang X Nguyen
(74) *Attorney, Agent, or Firm* — Dentons US LLP

(57) ABSTRACT

The present invention relates to a blanket for offset printing and a manufacturing method thereof. The blanket for offset printing according to an exemplary embodiment of the present invention comprises a cushion layer, a support layer, and at least two surface printing layers, wherein the at least two surface printing layers comprise a silicon-based resin in which at least one of a hardness value, a fluorine group content value, and a silicon oil content value is different. The blanket for offset printing according to the exemplary embodiment of the present invention comprises the surface printing layer formed in at least two layers to prevent the surface printing layer from being swollen due to ink, thereby reducing a process waiting time and improving a process margin.

5 Claims, 2 Drawing Sheets

(56) References Cited

FOREIGN PATENT DOCUMENTS

| | | | | |
|---|---|---|---|---|
| JP | 05-330266 | A | | 12/1993 |
| JP | 5-330266 | A | | 12/1993 |
| JP | 08267952 | A | * | 10/1996 |
| JP | 08-300845 | A | | 11/1996 |
| JP | 1996-300845 | A | | 11/1996 |
| JP | 09-058146 | A | | 3/1997 |
| JP | 9-58146 | A | | 3/1997 |
| JP | 2005-111665 | A | | 4/2005 |
| JP | 2006-159822 | A | | 6/2006 |
| JP | 2009-023116 | A | | 2/2009 |
| JP | 2009-184268 | A | | 8/2009 |
| JP | 2009-190264 | A | | 8/2009 |

OTHER PUBLICATIONS

Shin-Etsu Comprehensive Data Guide (first published 2005).*

* cited by examiner

PRIOR ART

BLANKET FOR OFFSET PRINTING AND MANUFACTURING METHOD THEREFOR

This application is a national stage application of PCT/KR2011/001891, filed on Mar. 18, 2011, which claims priority from Korean Patent Application No. 10-2010-0024859, filed on Mar. 19, 2010, in the Korean Intellectual Patent Office, the disclosures of which are incorporated herein by reference in their entireties.

TECHNICAL FIELD

The present invention relates to a blanket for offset printing and a manufacturing method thereof, and more particularly, to a blanket for offset printing having characteristics of reduced swelling ratio and a manufacturing method thereof. This application claims priority from Korean Patent Application No. 10-2010-0024859 filed on Mar. 19, 2010 in the KIPO, the disclosure of which is incorporated herein by reference in its entirety.

BACKGROUND ART

Generally, electronic devices such as a liquid crystal display, a semiconductor device, or the like, are manufactured by forming patterns of multiple layers on a substrate. In order to form these patterns, a photolithography process has been mainly used up to now. However, the photolithography process manufactures predetermined pattern masks and repeats a chemical etching process and a stripping process, such that the manufacturing process is complicated and a large amount of chemical wastes harmful to environment occur. This increases manufacturing costs, thereby degrading competitiveness of products. As a new method of forming patterns in order to solve the problems of the photolithography process, a roll printing method using a printing roll has been proposed.

Although there are various roll printing methods, a gravure printing method and a reverse offset printing method may be largely classified.

The gravure printing, which is a printing method that performs printing by covering ink on a concave plate and scratching extra ink, has been known as a method suitable for printing of various fields such as publication, packaging, cellophane, vinyl, polyethylene, or the like. A study to apply the gravure printing method to manufacturing of active devices or circuit patterns used for display devices has been conducted. Since the gravure printing transfer ink to the substrate by using a transfer roll, the patterns may be formed by one-time transfer by using the transfer roll corresponding to an area of the desired display device even in the case of a large-area display device. The gravure printing forms the ink patterns for resist on the substrate and may be used to pattern various patterns of display devices, for example, a TFT and a gate line and a data line connected to the TFT, a pixel electrode, a metal pattern for a capacitor, in the case of a liquid crystal display device.

However, the blanket used for general gravure printing is manufactured by casting a silicon-based resin into a solid master mold. The blanket manufactured as described above may have a limitation in manufacturing to have a uniform thickness and is difficult to mass produce as a pilot scale. Therefore, in order to precisely form fine patterns, the reverse offset printing method is mainly adopted.

The related art relating to the reverse offset printing method and the printing apparatus may refer to Documents 1 to 3 which was filed and published by an applicant of the present invention.

[Document 1] KR 10-2008-0090890 (Publication) Oct. 9, 2008

[Document 2] KR 10-2009-0020076 (Publication) Feb. 26, 2009

[Document 3] KR 10-2009-0003883 (Publication) Jan. 12, 2009

The entire contents of the specifications of Documents 1 to 3 are a description of the related art of the present invention and are described in the specification of the present invention.

FIG. 1 shows a section of a structure of a blanket according to the related art that is generally used for reverse offset printing. As shown in FIG. 1, the blanket according to the related art is configured to comprise a surface printing layer, a support layer, and a cushion layer and may further comprise a primer layer so as to secure adhesion between the layers. The surface printing layer is a layer that is directly covered with ink and transferred and is mainly manufactured by poly-di-methyl-siloxane (PDMS) and the support layer serves to support the surface printing layer and the cushion layer and is mainly manufactured by a PET film.

Further, the cushion layer serves to compensate the difference in thickness when the surface of the surface printing layer is not uniform and is mainly manufactured by the PDMS, similar to the surface printing layer.

The reverse offset printing method is a technology that is receiving considerable attention in view of saving costs and improving production speeds at the time of forming patterns, but requires a good quality of blanket so as to obtain a precise pattern. That is, since the quality of the patterns may depend on the characteristics of the blanket, the manufacturing of the high-quality printing blanket is a very important technical problem.

An example of factors to be considered so as to manufacture the excellent quality of blanket may comprise a) the thickness uniformity of the blanket, b) the hardness of the surface printing layer, c) presence or absence of foreign objects (bubble, dust, or the like) within the blanket, d) adhesion between the layers different from a base layer (base film), e) whether or not to introduce the cushion layer for process stability and performance degree, f) slip property of the cushion layer, g) the content of low-molecular silicon oil comprised in the surface printing layer, and h) a swelling ratio of ink and a solvent on the surface printing layer.

In particular, when the surface printing layer is swollen well by ink and a solvent, or the like, the time to dry the ink is long, such that the process waiting time is increased and the process margin is not good.

DISCLOSURE

Technical Problem

The present invention has been made in an effort to provide a blanket for offset printing capable of reducing a swelling ratio of a surface printing layer due to ink and reducing process waiting time accordingly and improving a process margin, in the blanket for offset printing comprising a surface printing layer, a support layer, and a cushion layer.

Further, the present invention has been made in an effort to provide a manufacturing method of the blanket for printing.

Technical Solution

An exemplary embodiment of the present invention provides a blanket for offset printing, comprising: a cushion layer, a support layer, and at least two surface printing layers, wherein each of the at least two surface printing layers comprises a silicon-based resin in which at least one of a hardness value, a fluorine content value, and a silicon oil content value is different from each other.

Another exemplary embodiment of the present invention provides a manufacturing method of a blanket for offset printing, the method comprising: 1) forming a cushion layer on one surface of a support layer and forming a first surface printing layer on the other surface of the support layer; and 2) forming a second surface printing layer on the first surface printing layer.

Yet another exemplary embodiment of the present invention provides a printing roll comprising the blanket for offset printing.

Advantageous Effects

As set forth above, the exemplary embodiment of the present invention comprises the silicon-based resin in which at least one of the hardness value, the fluorine content value, and the silicon oil content value within at least two surface printing layers are different, thereby remarkably reducing the swelling ratio of the surface printing layer due to the ink and reducing the process waiting time accordingly and improving the process margin, while maintaining the excellent printing capability.

BEST MODE

Hereinafter, exemplary embodiments of the present invention will be described in detail.

A blanket for offset printing according to an exemplary embodiment of the present invention comprises a cushion layer, a support layer, and at least two surface printing layers. Each of the at least two surface printing layers comprise a silicon-based resin in which at least one of a hardness value, a fluorine content value, and a silicon oil content value is different from each other.

In the blanket for offset printing according to the exemplary embodiment of the present invention, one surface of the support layer may be provided with a cushion layer and the other surface thereof may be provided with at least two surface printing layers.

In the blanket for offset printing according to the exemplary embodiment of the present invention, the silicon-based resin may use one known to the art and more particularly, may use poly-di-methyl-siloxane (PDMS).

The blanket for offset printing according to the exemplary embodiment of the present invention may comprise a first surface printing layer on a support layer and may comprise a second surface printing layer on the first surface printing layer.

Figure 1:
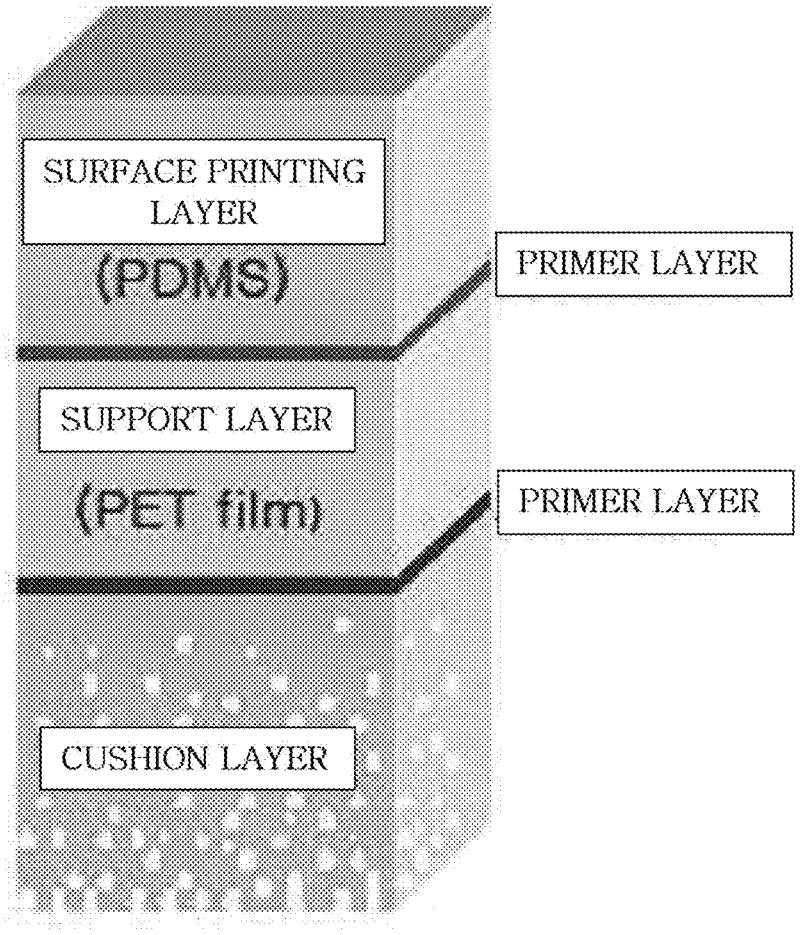
FIG. 1 is a diagram showing a structure of a blanket according to the related art that is used for reverse offset printing.
Figure 2:
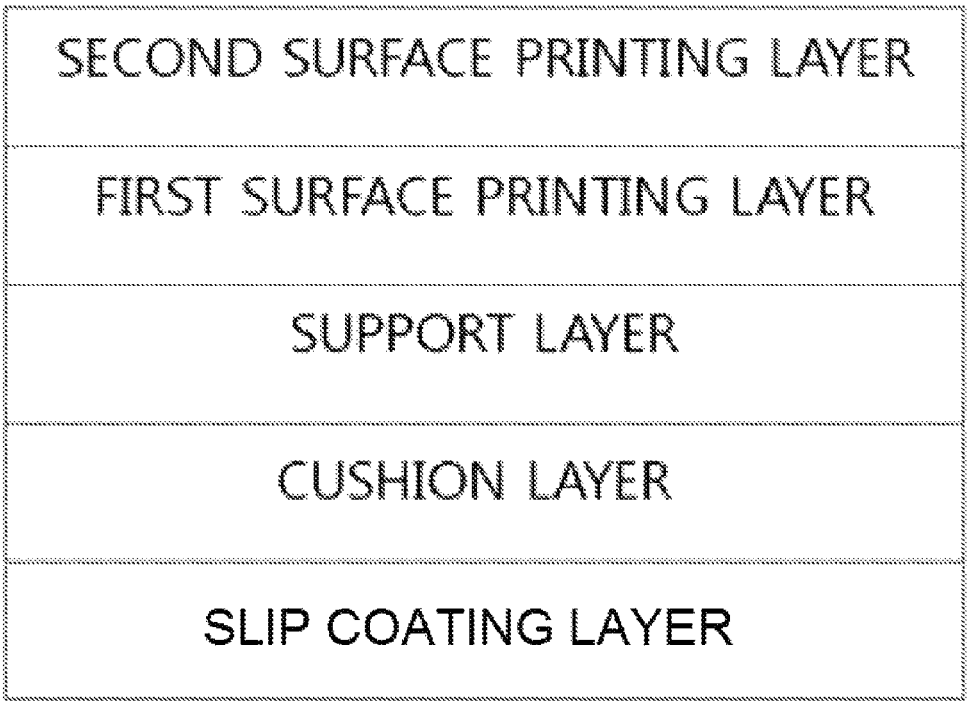
FIG. 2 is a diagram showing a structure of a blanket for reverse offset printing according to an exemplary embodiment of the present invention.

FIG. 2 shows a structure of a blanket for offset printing according to an exemplary embodiment of the present invention. Hereinafter, the blanket for offset printing according to the exemplary embodiment of the present invention will be described in detail with reference to FIG. 2.

The surface printing layer configured in plural layers according to the exemplary embodiment of the present invention may comprise a first surface printing layer formed on the support layer and a second surface printing layer formed on the first surface layer and forming an outermost layer of the surface printing layer.

The surface printing layer is a layer that is directly covered with ink and transferred and is mainly made of a silicon-based resin such as poly-di-methyl-siloxane (PDMS), and the first surface printing layer and the second surface printing layer according to the exemplary embodiment of the present invention may be preferably made of a PDMS material. However, the first surface printing layer and the second surface printing layer according to the exemplary embodiment of the present invention is made of PDMS layers having natures different from each other capable of reducing the swelling phenomenon of the entire surface printing layer. In the exemplary embodiment of the present invention to be described below, each of the first surface printing layer and the second surface printing layer is made of PDMSs in which the hardness value, the presence or absence of a fluorine group, or the presence or absence of silicon oil are different from each other.

1) At Least Two Surface Printing Layers Having Different Hardness Value

The blanket for printing according to the exemplary embodiment of the present invention may comprise the surface printing layer made of at least PDMSs having different hardness values.

That is, in FIG. 2, the first surface printing layer applied on the support layer has a hardness value of 50 or more and 65 or less and the second surface printing layer formed on the first surface printing layer may comprise the surface printing layer made of PDMS having a hardness value of 30 or more and below 50.

In order to manufacture the excellent quality of blanket, the hardness value of the surface printing layer is very important. In order to form the high-quality printing pattern, it is advantageous in thinly forming the surface printing layer, if possible. As the process is continued, ink or a solvent is excessively penetrated into the surface printing layer called a rubber layer, such that the surface printing layer may be swollen (hereinafter, referred to as "swelling phenomenon") and ink may be excessively printed. However, when the surface printing layer is too thin, the durability is deteriorated, thereby deteriorating the lifespan of the blanket for printing and the printing capability. Further, when the surface printing layer is thick, the floor contact phenomenon and the tail rolling phenomenon may occur due to the swelling phenomenon during the printing. Therefore, the exemplary embodiment of the present invention is not limited to the manufacture of the thin surface printing layer that has a technical limitation as described above, but provides the PDMS layer having different hardness values on the surface printing layer, thereby solving the above-mentioned problems.

The PDMS layer having the hardness of 50 or more and 65 or less does not facilitate the absorption of ink or a solvent and has the durability suitable for the blanket for printing, such that the swelling phenomenon of the surface printing layer due to the excessive penetration of the solvent may be maximally suppressed, the process waiting time may be reduced, and the efficiency of the process margin may be increased.

However, the outermost layer of the surface printing layer absorbs the ink or the solvent to some degree to smoothly perform the printing and to obtain the preferred effect in view of the sharpness. Therefore, in the exemplary embodiment of the present invention, the second surface printing layer having the hardness lower than that of the first surface printing layer is formed on the first surface printing layer having the hardness of 50 or more and 65 or less, such that the ink or the solvent is sufficiently absorbed by the second surface printing layer, thereby increasing the sharpness of the printing while smoothing the printing.

If the hardness of the second surface printing layer is lower than that of the first surface printing layer, the hardness is not particularly limited. Preferably, the PDMS having the hardness of 30 or more and below 50 is used.

As described above, the blanket for printing having the good durability and the excellent printing characteristics while suppressing the swelling phenomenon of the surface printing layer may be manufactured by forming the first surface printing layer having the relatively higher hardness and the second surface printing layer having the lower hardness thereon.

In addition, the net structure in which the PDMS is dense is formed when the hardening is performed at high temperature by comprising at least two surface printing layers having different hardness as described above, thereby preventing the solvent from being penetrated. In addition, if the hardness is high, the deformation of the PDMS is small, such that the surface printing layer according to the exemplary embodiment of the present invention is advantageously acted in view of the dimensional deformation. Therefore, it is possible to provide the blanket for printing having the conditions to allow the PDMS to be hardened at high temperature by forming the surface printing layer having different hardness as described above and the surface printing layer to be printed well.

When the PDMS layers have the above-mentioned conditions, the PDMS layer is not particularly limited. In detail, in the case of the exemplary embodiment of the present invention, as the first surface printing layer, ELASTOSIL RT607 manufactured by Wacker Chemie AG is used, and as the second surface printing layer, KE1606/CAT-RG manufactured by Shin-Etsu Chemical Co., Ltd. is used, but the PDMS layers are not limited thereto.

In the present specification, the hardness value means a Shore A hardness value. The Shore A hardness depends on JIS K 6301 (spring type A type) standard as the general method of measuring the rubber hardness and the test spring load is 539 to 8,379 mN. A product model used in the exemplary embodiment of the present invention is GS-706G manufactured by TECLOCK Corporation, and in the case of the PDMS blanket, the measurement may not be made in a bulk form. Therefore, after the blanket is stacked above 6 mm, the average value obtained by repeating five times the hardness value measured by closing the hardness meter to the stacked blanket for 1 second was used.

3) At Least Two Surface Printing Layers According to Presence or Absence of Fluorine Group The surface printing layer of the blanket for printing according to the exemplary embodiment of the present invention may comprise the surface printing layer configured of in a plurality of layers, which are configured of the Fluorine-containing PDMS and non-fluorine-containing PDMS.

That is, in FIG. 2, the first surface printing layer is the fluorine-containing PDMS and the second surface printing layer does not comprise a fluorine group.

As described above, the fluorine-containing first surface printing layer has the fluorine group comprised in a space between the chains of the PDMS, thereby preventing the solvent from being penetrated. Therefore, the first surface printing layer has the effect capable of preventing the problems in that the surface printing layer is excessively swollen due to the excessive penetration of the solvent, such that the printing quality is degraded and the printing process time is increased.

However, in the case of applying the fluorine-containing PDMS to the outermost layer portion of the surface printing layer, the solvent may not be sufficiently absorbed at the time of printing, such that the printing quality may be degraded and the excessive amount of oil may be transferred at the time of printing, thereby deteriorating the sharpness of the printing pattern.

Therefore, the second surface printing layer may be made of the non-fluorine-containing PDMS.

The fluorine group content comprised in the first surface printing layer may be comprised as 1 to 15 wt % with respect to the total weight of the PDMS of the first surface printing layer.

When the silicon oil of the first surface printing layer is comprise less than 1 wt %, the expectation effect of the fluorine-containing surface printing layer may not be sufficiently exhibited. On the other hand, the case in which the fluorine group exceeding 15 wt % is added is considered as the addition of the excessive amount, such that the dry time of the first surface printing layer is long and the problem of degrading the printing quality may occur.

The fluorine-containing PDMS is not particularly limited, and preferably, the PDMS copolymerized with the fluorine functional group is effective. In detail, in the case of the present invention, vinyl terminated trifluoropropyl methyl siloxane manufactured by Gelest Inc. is used, but the present invention is not limited thereto.

If the PDMS of the second surface printing layer is the PDMS of the generally used blanket for printing, the PDMS is not particularly limited.

3) At Least Surface Printing Layers According to Presence or Absence of Silicon Oil The surface printing layer of the blanket for printing according to the exemplary embodiment of the present invention may comprise the surface printing layer configured of in a plurality of layers, which are configured of the PDMS comprising the silicon oil and the PDMS not comprising the silicon oil.

That is, in FIG. 2, the first surface printing layer is the PDMS comprising the silicon oil and the second surface printing layer does not comprise the silicon oil.

As described above, the first surface printing layer comprising the silicon oil has the oil in a space between the chains of the PDMS, thereby preventing the solvent from being penetrated. Therefore, the first surface printing layer has the effect capable of preventing the problems in that the surface printing layer is excessively swollen due to the excessive penetration of the solvent, such that the printing quality is degraded and the printing process time is increased.

However, in the case of applying the PDMS comprising the silicon oil to the outermost layer portion of the surface printing layer, the solvent may not be sufficiently absorbed at the time of printing, such that the printing quality is degraded may occur and the excessive amount of oil may be transferred at the time of printing, thereby deteriorating the sharpness of the printing pattern.

Therefore, the second surface printing layer may be preferably made of the PDMS not comprising the silicon oil.

It is preferable that the amount of the silicon oil comprised in the first surface printing layer is 1 to 10 wt % with respect to the total weight of the PDMS of the first surface printing layer.

When the silicon oil of the first surface printing layer is comprised less than 1 wt %, the expectation effect of the surface printing layer comprising the silicon oil may not be sufficiently exhibited. On the other hand, the case in which the silicon oil exceeding 10 wt % is added is considered as the addition of the excessive amount, such that the dry time of the first surface printing layer is long and the problem of degrading the printing quality due to the absorption of the silicon oil into the second surface printing layer may occur.

Each thickness of the first surface printing layer and the second surface printing layer according to the exemplary embodiment of the present invention is not particularly limited. However, the thickness of the entire surface printing layer that sums the thickness of the first surface printing layer and the thickness of the second surface printing layer is enough to be in the range of 0.01 to 1.2 mm, and more preferably, it is required that the thickness of the entire surface printing layer is in the range of 200 to 800 μM. In order to form the thickness of the surface printing layer less than the range, the coat quantity of the PDMS used for the surface printing layer is small.

Hereinafter, the manufacturing method according to the exemplary embodiment of the present invention will be described in more detail with reference to processes of forming each layer of the blanket according to the exemplary embodiment of the present invention.

The manufacturing method of the blanket for offset printing according to the exemplary embodiment of the present invention comprises 1) forming the cushion layer on one surface of the support layer and forming the first surface printing layer on the other surface of the support layer and 2) forming the second surface printing layer on the first surface printing layer.

First, the base used for the blanket for printing is prepared. The base serves as the support layer. As the base, the film that has small flexibility is preferably used so as to suppress the expansion and contraction of the surface printing layer and the cushion layer and improve the precision of the printing. In particular, the film made of resin in which the tension elasticity at a normal temperature is 1,000 MPa or more, in particular, 2,000 to 5,000 MPa is appropriate. An example of the film may comprise a polyester film, a polycarbonate film, or the like, such as polyethylene terephthalate (PET), or the like.

The thickness of the base is not limited, but is appropriately 0.1 to 0.5 mm, and preferably, 0.2 to 0.45 mm. When the thickness of the base is below the range, the effect of reinforcing and supporting the cushion layer or the surface printing layer due to the corresponding base may be insufficient.

Next, the liquid-phase mixture comprised in the cushion layer formed on one surface of the base is prepared. The mixture is prepared by mixing the liquid-phase silicon resin with the hollow microsphere so as to uniformly disperse the hollow microsphere in the liquid-phase silicon resin.

As the hollow microsphere, one disclosed in U.S. Pat. No. 4,770,928 or the like may be used. In particular, when considering the swelling prevention due to ink, the microsphere of which the skin body is formed with homopolymer such as polymerized monomer such as vinylidene chloride, met arcylonitrile, or the like, or copolymer comprising at least two or more of the above-mentioned monomers is preferable.

The grain size of the hollow microsphere is not particularly limited, but the average grain size thereof may be 20 to 200 μm, and particularly, 40 to 150 μm in order to well exhibit an effect of controlling the printing pressure due to the cushion layer.

The hollow microsphere may be mixed at a ratio of 1 to 30 parts by weight to 100 parts by weight of the liquid-phase silicon resin. When the mixing proportion of the hollow microsphere is below the range, the effect of controlling the printing pressure due to the cushion layer is not obtained. Further, when the mixing proportion of the hollow microsphere exceeds the range, the cushion layer is smooth, thereby degrading the precision of the printing. In addition, when the viscosity of the mixture is increased, the mixture may not be uniformly applied at a desired thickness.

Next, the cushion layer is formed by hardening the silicon resin at a state of horizontally maintaining the base simultaneously with applying the mixture on the one surface of the base. To this end, a surface plate of which the level is maintained, or the like, may be used. As a result, the hollow microsphere has a gradient in a thickness direction by uniformly forming the thickness of the mixture by a weight of the mixture itself and hardening the mixture.

In order to apply the mixture to the one surface of the base, a roll coater, a bar coater, a flow coater, a gravure coater, a spray, an applicator, or the like, may be used. In addition, the base may be preferably in the state in which the level is completely maintained and may be preferably in the state in which the substrate closely contacts with the horizontal object. To this end, a method of applying tension to both sides of the base film and closing the level member (or surface plate) to the surface of the level member and a method of mounting the fine sucking holes on the level member and sucking and closely contacting it through the holes, or the like, may be used.

All of the thermosetting, room-temperature curable, catalyst curable silicon resin may be used, but the exemplary embodiment of the present invention uses the catalyst curable silicon resin. The predetermined time is fixed and the hardening reaction is made under the room temperature environment (23±3° C.) without heating the mixture after applying the mixture. Thereby, the volatilization of the low-molecular silicon oil may be prevented, the expansion or breakage of the hollow microsphere may be prevented, and the heat energy necessary for the hardening process may be saved.

The thickness of the cushion layer is not particularly limited, but is preferably 0.05 to 2 mm, and more preferably, 0.3 to 1 mm. When the thickness of the cushion layer is below the range, the effect of controlling the printing pressure of the corresponding cushion layer may not be sufficiently obtained, and when the thickness of the cushion layer exceeds the range, the thickness of the substrate is relatively small, such that the support effect between the layers of the base may be degraded.

Next, the surface printing layer is formed on one surface on an opposite side to the remaining surface of the base. The surface printing layer is a non-porous layer. The non-porous surface printing layer may be formed according to several forming methods, but in particular, a method of hardening the liquid-phase silicon resin and forming the surface printing layer integrated with the base in which the base is maintained in a horizontal state, simultaneously with applying the liquid-phase silicon resin to the opposite surface of the base is preferable.

In the surface printing layer according to the exemplary embodiment of the present invention, the first surface printing layer is formed on the base and is sufficiently dried, and then, the second surface printing layer is formed thereon.

In this case, the time to apply the second surface printing layer on the first surface printing layer is suitable for about 20 to 50% of pot life (a term that means the time to increase viscosity twice larger than initial viscosity and is widely used in the art mainly associated with an adhesive). When the pot life is below 20%, the silicon resin of the first surface printing layer is not still sufficiently hardened. In this state, when the silicon resin of the second surface printing layer is immediately seated, the thickness of the first surface printing layer may be affected, such that it is difficult to sufficiently expect the preferred effect due to the existence of the first surface printing layer. In addition, when the pot life exceeds 50%, since the silicon resin of the first printing surface layer is hardened to some degree, the first surface printing layer and the second surface printing layer may not be completely combined in the integrated state and the uniformity of the surface printing layer may be affected adversely.

The printing blanket according to the exemplary embodiment of the present invention may further comprise a slip coating layer in addition to the surface printing layer, the support layer, and the cushion layer. The slip coating layer serves to well mount the printing blanket on the roll, or the like, by relieving the stickiness of the cushion layer. Further, the slip coating layer does not have stickiness, and further, have an appropriate roughness necessary for mounting.

The slip coating layer may be formed by coating the slip coating liquid on the cushion layer. The slip coating liquid may be prepared by appropriately mixing the silicon resin, the silicon oil, the siloxane of which the end is substituted into hydrogen, and the silica particles, or the like. The slip coating liquid may be coated by a mayer bar or a baker applicator.

The overall thickness of the blanket for printing having each layer according to the exemplary embodiment of the present invention is preferably 0.7 to 3 mm, and more preferably, 0.9 to 2 mm. When the thickness of the blanket for printing is below the range, the effect of controlling the printing pressure of the blanket for printing may be degraded, and when the thickness of the blanket for printing exceeds the range, the thickness of the blanket is too large, such that the work of winding the blanket around the roll may be difficult.

The primer layer may be formed between the base and the layers in order to increase the adhesion and integrity between the base and the layers. The primer layer may be formed at any thickness so as to meet the purpose without limitation. The material of the primer layer may use one comprising a silane coupling agent having good affinity with the silicon resin When the cushion layer and the surface printing layer are formed without the primer layer, the surface of the base is physically or chemically surface-treated to impart the affinity to the silicon resin and it is preferable to secure the adhesion for the base by applying the mixture to the one surface of the base.

MODE FOR INVENTION

Hereinafter, the present invention will be described in more detail with reference to examples. The examples in the present specification are for the detailed description of the invention but are not limited to the scope of the present invention.

EXAMPLES

Example 1

At Least Two Surface Printing Layers Having Different Hardness Value

The cushion layer forming mixture was prepared by adding 100 parts by weight of the liquid-phase silicon resin and 10 parts by weight of the hollow microsphere (MFL80CA manufactured by Matsumoto Yushi-Seiyaku Co., Ltd.), mixing and uniformly dispersing them, and then, further adding 10 parts by weight of hardener.

Next, after the tension was applied to the polyethylene-terephthalate (PET) base film having about 0.35 mm on the surface plate of which the level is maintained in a manner of pulling both ends thereof, the PET closely contacting the surface plate in vacuum in order to completely closely contacting the surface plate and then, the vacuum was removed after coating so as not to leave the marks of the vacuum hole of the PET.

Then, the cushion layer forming mixture was uniformly applied to an area of about 120 cm×150 cm on one surface of the base by using an applicator. The cushion layer having a thickness of 0.7 mm was formed by hardening the mixture at room temperature (23±3° C.) for about three days.

Next, the slip coating layer having a thickness of about 5 μm was formed by applying the silicon resin comprising silica to the surface of the cushion layer by using a mayer bar and drying it at room temperature for about 24 hours, while maintaining the state in which the base film closely contacting the surface of the surface plate.

Thereafter, after the base film was inverted and one surface of the opposite side of the base film was positioned to be turned, the base was completely close to the surface plate by applying the tension to the base film in the same method as the above-mentioned method.

ELASTOSIL RT607 (hardness: 56) having the relatively high hardness manufactured by Wacker Chemie AG was uniformly applied to an area of about 120 cm×150 cm on the first surface printing layer by using the applicator. In this case, the application thickness of the first surface printing layer was about 0.35 mm.

The applied first surface printing layer maintained level by a gravity force and after 6 hours elapses, KE1606/CAT-RG having relatively low hardness manufactured by Shin-Etsu Chemical Co., Ltd. (the printing layer in which KE 1606 silicon resin and CAT-RG hardener are mixed at a weight ratio of 10:1; hardness 42) was uniformly applied to the area of about 120 cm×150 cm on the second surface printing layer by using the applicator. In this case, the application thickness of the second surface printing layer was also about 0.35 mm.

Thereafter, the surface printing layer was formed by hardening at room temperature (23±3° C.) for about three days and the blanket for printing was completed finally.

The hardness value means a Shore A hardness value. The Shore A hardness depends on JIS K 6301 (spring type A type) standard as the general method of measuring the rubber hardness and the test spring load is 539 to 8,379 mN. A product model used in the exemplary embodiment of the present invention is GS-706G manufactured by TECLOCK Corporation and in the case of the PDMS blanket, the measurement may not be made in a bulk form. Therefore, after the blanket was stacked 6 mm or more, the average value obtained by repeating five times the hardness value measured by closely contacting the hardness meter to the stacked blanket for 1 second was used.

Example 2

At Least Two Surface Printing Layers According to Presence or Absence of Fluorine Group After the printing layer made by comprising the fluorine-based PDMS containing resin and vinyl terminated trifluoro propyl methyl siloxane of 10 wt % manufactured by Gelest Inc., in KE1606 was applied to the first surface printing layer and was hardened at normal temperature for three days, the blanket for printing was completed by the same manner as Example 1, except for preparing the mixture by mixing and uniformly dispersing the hardener of 10 parts by weight for 100 parts by weight of the silicon resin to the second surface printing layer and applying the mixture to the first surface printing layer by using the applicator.

Example 3

At Least Two Surface Printing Layers According to Presence or Absence of Silicon Oil After the mixed resin of the silicon oil of 5 wt % for the PDMS (KE1606/CAT-RG 10:1 manufactured by Shin-Etsu Chemical Co., Ltd.) was applied to the first surface printing layer and was hardened at normal temperature for three days, the blanket for printing was completed by the same manner as Example 1, except for preparing the mixture by mixing and uniformly dispersing the hardener of 10 parts by weight for 100 parts by weight of the silicon resin to the second surface printing layer and applying the applying to the first surface printing layer by using the applicator.

Comparative Example

The cushion layer forming mixture was prepared by adding 100 parts by weight of the liquid-phase silicon resin and 10 parts by weight of the hollow microsphere (MFL80CA manufactured by Matsumoto Yushi-Seiyaku Co., Ltd.), mixing and uniformly dispersing them, and then, further adding 10 parts by weight of hardener.

After the tension is applied to the polyethyleneterephthalate (PET) base film having a thickness of about 0.35 mm on the surface plate of which the level is maintained in a manner of pulling both ends thereof, the PET base film was completely close to the surface plate.

Then, the cushion layer forming mixture was uniformly applied to the area of about 120 cm×150 cm on the one surface of the base surface by using the applicator. The cushion layer having a thickness of 0.7 mm was formed by hardening the mixture at room temperature (23±3° C.) for about three days.

Next, the slip coating layer having a thickness of about 5 μm was formed by applying the silicon resin comprising silica to the surface of the cushion layer by using the mayer bar and drying it at room temperature for about 24 hours, while maintaining the state in which the base film closely contacting the surface of the surface plate.

Thereafter, after the base film was inverted and the one surface of the opposite side of the base film was positioned to be turned, the base was completely close to the surface plate after applying the tension to the base film in the same method as the above-mentioned method.

The surface printing layer forming mixture was manufactured by mixing and uniformly dispersing hardener of 10 parts by weight for 100 parts by weight of the liquid-phase silicon resin and the surface printing layer forming mixture was uniformly applied to the area of about 120 cm×150 cm on the remaining one surface of the base surface by using the applicator. In this case, the application thickness of the mixture was about 0.7 mm.

Thereafter, the surface printing layer was formed by being hardened at room temperature (23±3° C.) for about three days and the printing blanket was completed finally.

Experimental Example

Swelling Measurement Experiment

The experiment of measuring the swelling ratio of the blankets manufactured in the examples and the comparative example was made as follows.

In order to measure the swelling ratio, after the blankets manufactured by each example and the comparative example by using the solvent substantially used for the printing ink, that is, propylene glycol monomethyl ether acetate (PGMEA) were dipped, the PC and the PGMEA was swollen to the printing layer so as to measure the swelling ratio as time goes on, such that the increased wt % was measured as time goes on and the results thereof were described in the following Table 1.

The blanket is swollen by the solvent of ink, such that the wetting characteristics of the surface are changed as time goes on. This is called the swelling and when the ink or the blanket of the anti-swell base is used, the change in the blanket surface wettablity is small, but considering the ink receptivity for the blanket or other printing characteristics, it is more advantageous to maintain the balance, together with slight swelling. In order to measure the swelling balance, the simplest and the most convenient gravimetric method may be used.

After the samples for each type are completely hardened in a dry oven and is cut at a size of 5 cm×5 cm and are dipped in propylene glycol monomethyl ether acetate (PGMEA) at a boiling point (BP) of 146° C., the change in weight of the samples was measured as time goes on. The swelling ratio (%) was calculated as (B−A)/A×100 from the measurement value of the sample weight A before the dipping and the sample weight B after the dipping for the predetermined time.

TABLE 1

| | PGMEA (wt %) | | |
|---|---|---|---|
| | 1 min | 5 min | 60 min |
| Comparative Example | 17 | 26 | 27 |
| Example 1 | 10 | 17 | 19 |
| Example 2 | 8 | 20 | 21 |
| Example 3 | 7 | 18 | 18 |

As shown in Table 1, the swelling degree of Examples 1 to 3 was smaller from the beginning than the comparative example (that is, the amount of the saturated solvent of the examples was smaller from the beginning than the comparative example). In addition, it can be said that the deswelling time with respect to the predetermined reference amount may be small. These results may be determined that Examples 1 to 3 prevent the solvent from being excessively absorbed due to the existence of the first surface printing layer and suppress the swelling ratio, unlike the comparative example.

That is, the exemplary embodiment of the present invention comprises the silicon-based resin in which at least one of the hardness value, the fluorine content value, and the silicon oil content value is different, thereby remarkably reducing the swelling degree of the surface printing layer due to the ink and reducing the process waiting time accordingly and improving the process margin, while maintaining the excellent printing capability.

The invention claimed is:

1. A blanket for offset printing, comprising:

a cushion layer, a support layer, and at least two surface printing layers;

wherein each of the at least two surface printing layers comprises a silicon-based resin in which at least one of a hardness value, a fluorine content value, and a silicon oil content value is different from each other, the blanket for offset printing comprises a first surface printing layer on the support layer and a second surface printing layer on the first surface printing layer, the first surface printing layer comprises a fluorine-containing silicon-based resin and the second surface printing layer comprises a non-fluorine-containing silicon-based resin, the fluorine content is 1 to 15 wt % based on the total weight of the silicon-based resin of the first surface printing layer, the silicon-based resin comprises siloxane, a slip coating layer is further provided on the cushion layer, the support layer is provided on one surface of the cushion layer and the slip coating layer is provided on the other surface of the cushion layer, the slip coating layer comprises a silicon resin, a silicon oil, a siloxane having at least one end terminated with a hydrogen atom, and silica particles, and wherein the first surface printing layer comprises the silicon oil and the silicon-based resin, the second surface printing layer comprises the silicon-based resin, and the content of the silicon oil is 1 to 10 wt % based on the total weight of the silicon-based resin of the first surface printing layer.

2. The blanket for offset printing of claim 1, wherein the first surface printing layer comprises the silicon-based resin having a hardness value of 50 or more and 65 or less, and the second surface printing layer comprises the silicon-based resin having a hardness value of 30 or more and below 50.

3. A printing roll comprising the blanket for offset printing of claim 2.

4. The blanket for offset printing of claim 1, wherein the total thickness of both the first and second surface printing layers is 200 to 800 μm.

5. A printing roll comprising the blanket for offset printing of claim 1.

* * * * *